US006048232A

United States Patent [19]

Chen

[11] Patent Number: 6,048,232

[45] Date of Patent: Apr. 11, 2000

[54] WITHDRAWABLE CONTACT AND A CONNECTOR USING THE SAME

[75] Inventor: Chu-Mei Chen, Taipei, Taiwan

[73] Assignee: Hon Hai Precision Ind. Co., Ltd., Taipei Hsien, Taiwan

[21] Appl. No.: 09/028,969

[22] Filed: Feb. 24, 1998

[30] Foreign Application Priority Data

Feb. 25, 1997 [TW] Taiwan ..... 86203055

[51] Int. Cl.[7] ..... H01R 13/40

[52] U.S. Cl. ..... 439/733.1; 439/825

[58] Field of Search ..... 439/733.1, 741, 439/884, 869, 870.2, 816, 817, 819, 825

[56] References Cited

U.S. PATENT DOCUMENTS

| | | | |
|---|---|---|---|
| 3,439,311 | 4/1969 | Evans | 439/844 |
| 4,878,863 | 11/1989 | Swengel, Jr. et al. | 439/884 |
| 5,692,928 | 12/1997 | Nelson et al. | 439/733.1 |

*Primary Examiner*—Lincoln Donovan

[57] ABSTRACT

A connector defining a plurality of apertures detachably receives a plurality of withdrawable contacts therein. Each contact includes a contacting portion, an intermediate portion which is formed with at least one curved concave portion for slidably receiving a protrusion projecting from at least one of two opposite inner walls which bound each aperture, and a soldering portion extending downward from the intermediate portion.

4 Claims, 6 Drawing Sheets

99

WITHDRAWABLE CONTACT AND A CONNECTOR USING THE SAME

BACKGROUND OF THE INVENTION

1. Field of the Invention

The present invention relates to a contact and a connector using the same, and particularly to a contact which is easily withdrawn from a corresponding housing of a connector thus allowing users to reuse the connector upon replacement of the withdrawable contacts.

2. The Prior Art

Expansion cards or functional module cards are commonly used in telecommunications or networks such as in exchangers and servers. Some of these cards are frequently replaced to allow for different functional requirements. The connector which receives the functional card is apt to have worn out gold-coated contact portions due to frequent friction between different functional cards and the contacts of the connector. Furthermore, some contacts fixed in the connector will be improperly bent or broken due to constant replacement of different functional cards thus resulting in a malfunction of the related appliances, e.g., the exchangers. If the connector is broken, technicians must remove the broken connector from a printed circuit board which is cumbersome and may damage or short the foils printed on the circuit board. Therefore, a new contact which can be easily removed from the related connector without damaging the inner structure thereof is required which can be replaced with an identical contact firmly positioned in the connector.

SUMMARY OF THE INVENTION

The primary purpose of the present invention is to provide an improved contact which can be easily removed from a related connector and replaced by the same which can be easily and firmly positioned in the connector.

A second purpose of the present invention is to provide an improved connector having contacts received therein which can be replaced with a new set of the same contacts when at least one of the contacts has a worn-out contact portion in the contacting region thereof or is bent thereby causing a malfunction.

In accordance with one aspect of the present invention, a withdrawable contact is retained in an aperture of a connector which has at least one protrusion projecting into the aperture from an inner wall thereof. The contact comprises a contact portion for electrical engagement with a corresponding contact of a complementary connector, an engaging portion which has at least a curved concave portion in an intermediate portion thereof for engaging with the at least one protrusion and facilitating the movement of the contact through the protrusion of the inner wall, and a soldering portion extending downward from the engaging portion.

In accordance with another aspect of the present invention an electrical connector comprises an insulative housing and at least one contact detachably received in the housing. The at least one contact is formed with at least one curved concave portion at an intermediate portion thereof. The insulative housing comprises a bottom, two side walls projecting upward from the bottom, and a slot defined between the bottom and the two side walls for receiving a complementary connector. At least one aperture is defined through the bottom of the insulative housing and is bound by at least two opposite inner walls. At least one protrusion projects laterally from an intermediate portion of at least one of the at least two inner walls, whereby the at least one curved concave portion of the at least one contact slidably engages with the at least one protrusion of the at least one of the at least two inner walls of the housing.

DETAILED DESCRIPTION OF THE PREFERRED EMBODIMENTS

Figure 1:
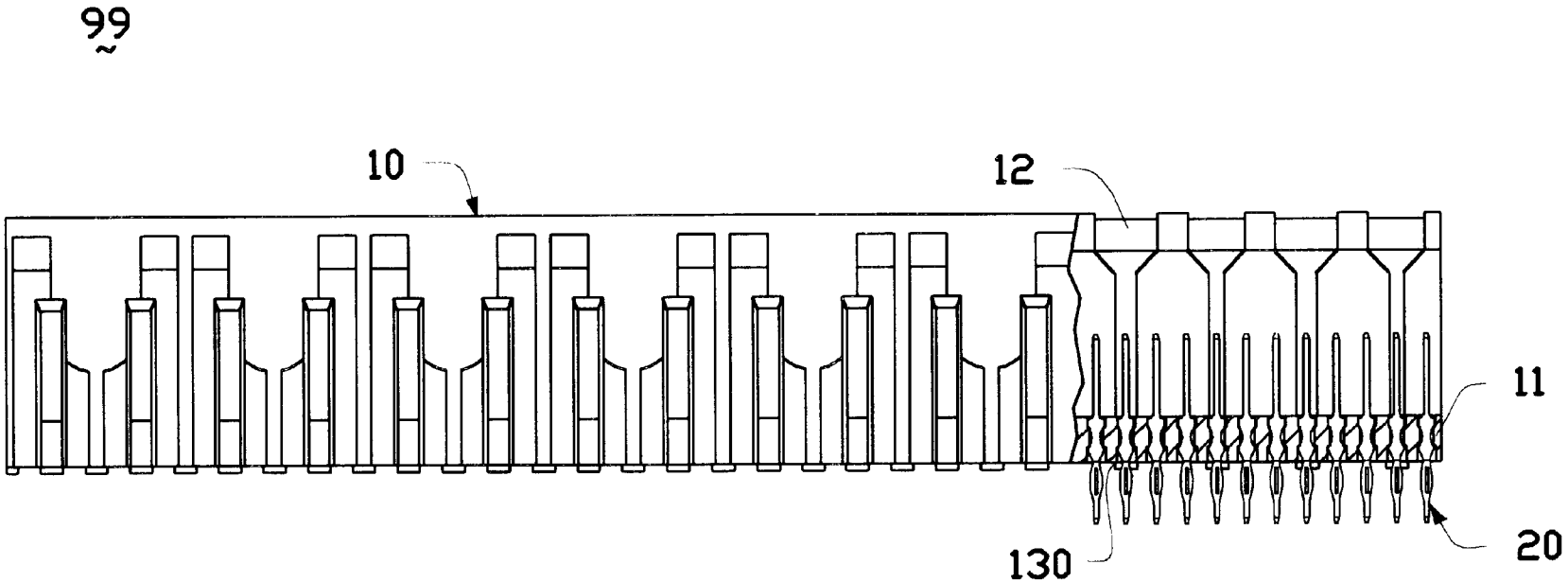
FIG. 1 is a front elevational view of a connector in accordance with the present invention, wherein a right closure portion thereof is cutaway to illustrate contacts in the connector.
Figure 2:
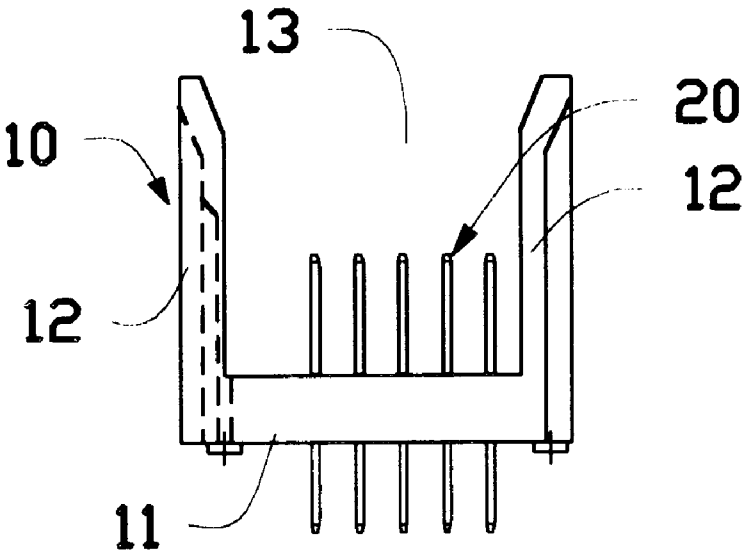
FIG. 2 is a side elevational view of the connector in accordance with the present invention.
Figure 3:
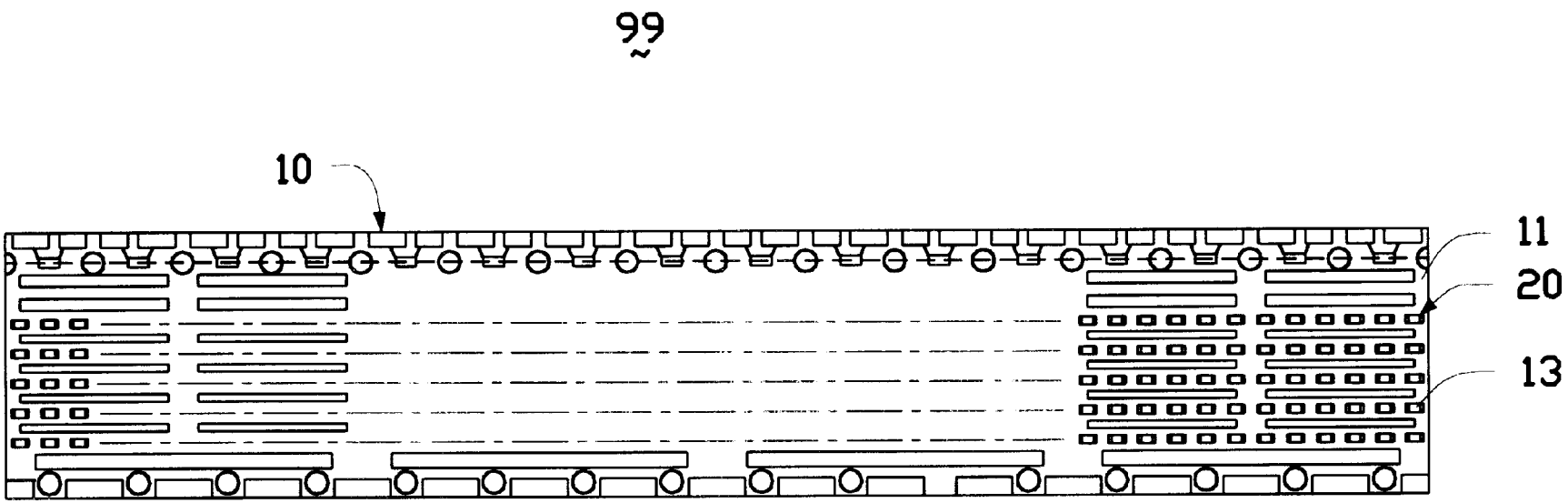
FIG. 3 is a top elevational view of the connector in accordance with the present invention.

Referring to FIGS. 1, 2, and 3, a connector 99 in accordance with the present invention comprises an insulative housing 10 and a plurality of withdrawable contacts 20. The insulative housing 10 comprises a bottom 11, two side walls 12 projecting upward from the bottom 11, and a slot 13 defined between the bottom 11 and the two side walls 12 for receiving a complementary connector (not shown). A plurality of apertures 130 (shown in FIG. 3 in four rows) are defined in the bottom 11 of the housing 10.

Figure 4:
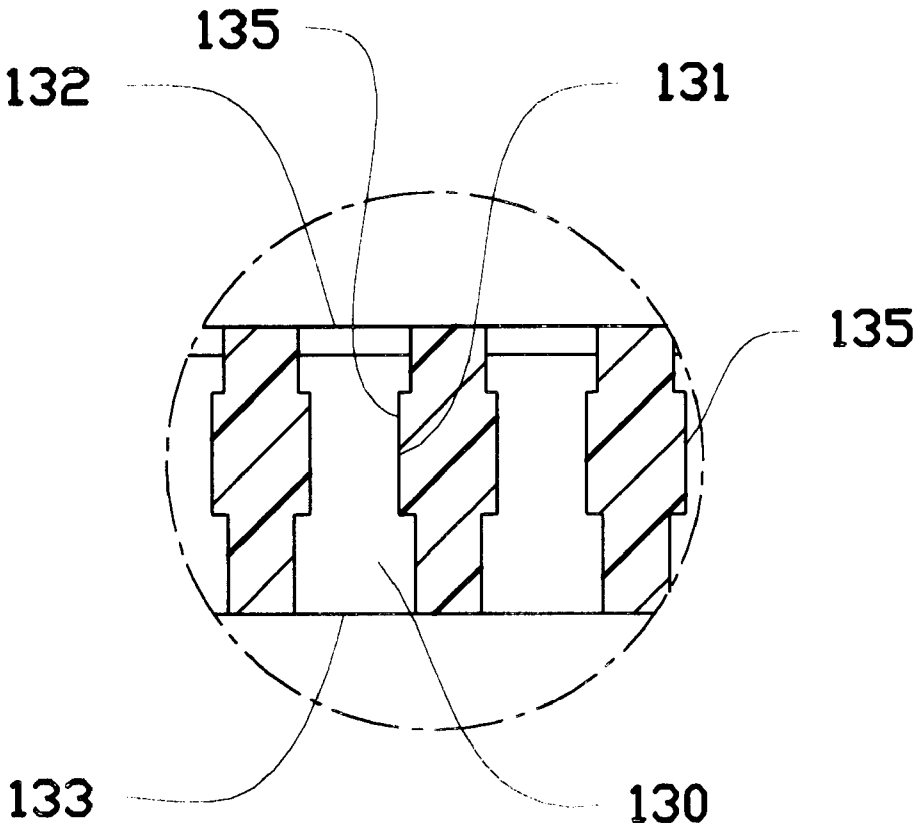
FIG. 4 is an enlarged view of the contact recess of the connector of the present invention.

Referring to FIG. 4, each aperture 130 is bound by two inner walls 131. Each inner wall 131 includes a protrusion portion 135 projected from an intermediate portion thereof. Furthermore, each aperture 130 has an upper opening 132 and a lower opening 133.

Figure 5:
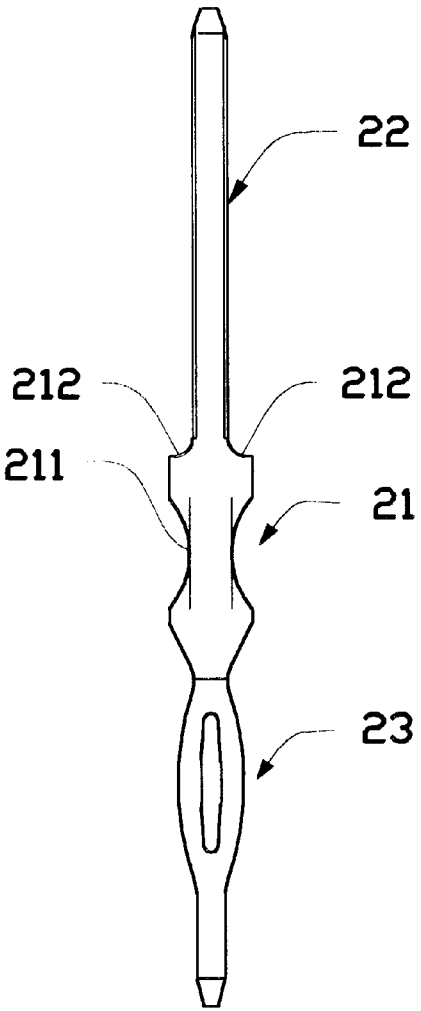
FIG. 5 is an elevational view of the contact used in the present invention.

Referring to FIG. 5, each contact 20 comprises a contacting portion 22 for electrically contacting with a corresponding contact of the complementary connector, an engaging portion 21 which forms a head 212 on the top, two curved concave portions 211 at opposite intermediate portions thereof for engaging with the protrusions 135 of the opposite inner walls 131 of the housing 10, a base 215 on the lower portion of which the width is generally equal to that of the head 212, and a soldering portion 23 for soldering on a printed circuit board (not shown) when the contact 20 is inserted into the aperture 130 from the upper opening 132 thereof, the soldering portion 23 of the contact 20 projects beyond the bottom of the housing 10.

Figure 6:
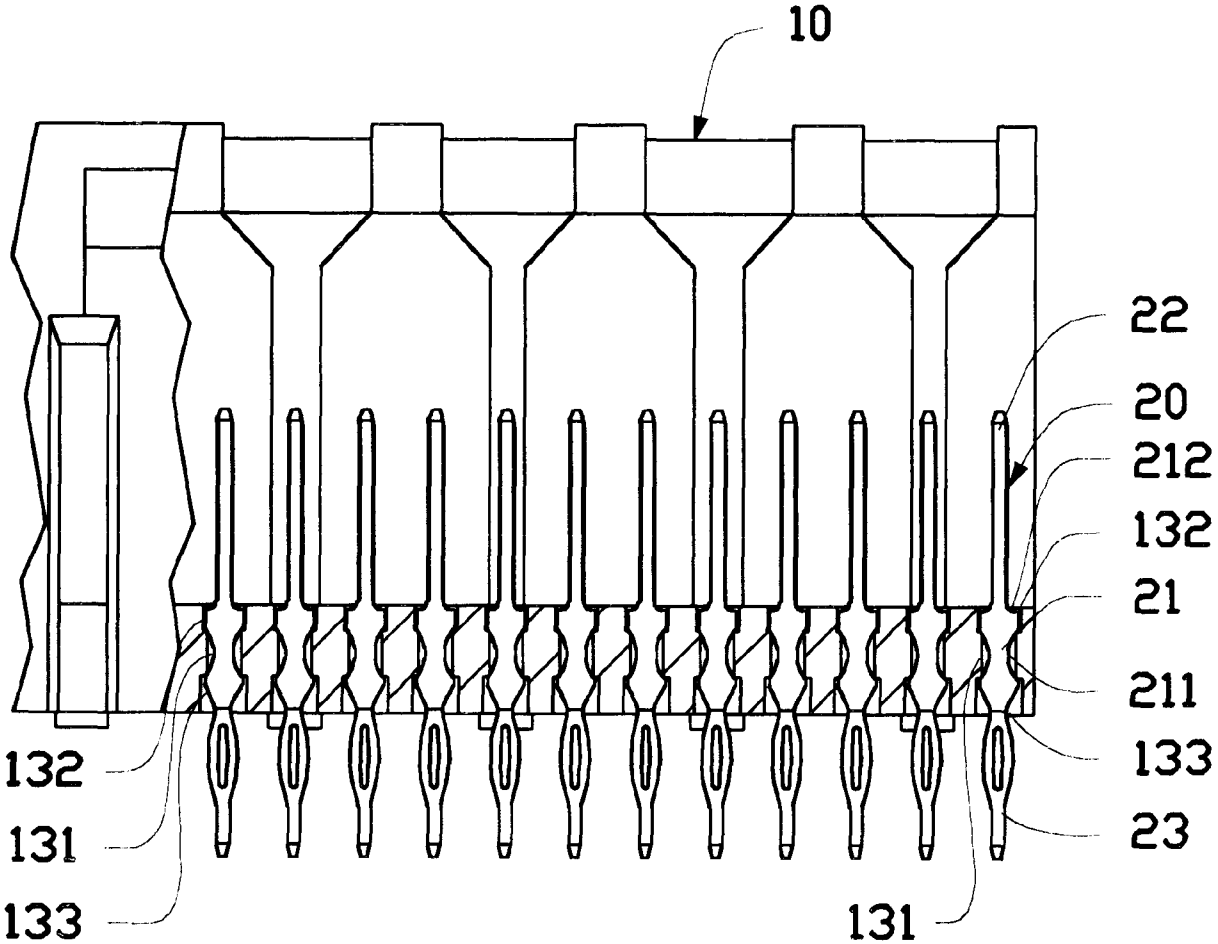
FIG. 6 illustrates the contacts received in the recesses of the connector of the present invention.

Referring to FIG. 6, the contact 20 is securely positioned in the aperture 130 by engagement of the engaging portion 21 with the opposite inner walls 131 of the housing 10. To strengthen the retention of the contact 20 within the aperture 130, the upper opening 132 is dimensioned to be substantially equal to the width of the head 212 of the engaging portion 21, therefore the contact 20 can be firmly retained in position when the complementary connector is engaged with the connector 99 of the present invention. The lower opening 133 of the aperture 130 is dimensioned to be wider than the base 215 of the engaging portion 21 of the contact 20 thereby allowing a worn or broken contact 20 to be easily replaced with a new contact 20. Moreover, the curved concave portion 211 of the engaging portion 21 of the contact 20 exerts a relatively small amount of friction on the protrusion 135 of the inner walls 131 during insertion/withdrawal of the contact 20 because the curved concave shape thereof can effectively reduce resistance.

It can be concluded from the above description that the new structure of the withdrawable contact 20 and the related connector 99 can fixedly position the contact in the connector as well as facilitate the insertion/withdrawal of the contact.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

an insulative housing and at least one contact detachably received in the housing, the at least one contact being formed with at least one curved concave portion at an intermediate portion thereof;

the insulative housing comprising a bottom, two side walls projecting upward from the bottom, and a slot defined between the bottom and the two side walls for receiving a complementary connector;

at least one aperture being defined in the bottom of the insulative housing bound by at least two opposite inner walls and at least one protrusion projecting laterally from an intermediate portion of at least one of the at least two inner walls;

wherein the at least one curved concave portion of the at least one contact slidably engages with the at least one protrusion of the at least one of the at least two inner walls of the housing;

wherein the at least one contact comprises a contacting portion for electrically contacting with a corresponding contact of the complementary connector received in the slot, an engaging portion including the at least one curved concave portion and being detachably received in the at least one aperture of the bottom of the housing, and a soldering portion extending from the engaging portion for being soldered to an external printed circuit board; and wherein the engaging portion of the at least one contact is formed with an upper portion, an intermediate portion which is formed with the at least one curved concave portion, and a lower portion, and wherein the intermediate portion is narrower than the upper portion and the lower portion.

2. The electrical connector as claimed in claim 1, wherein the at least one aperture of the bottom of the insulative housing has an upper opening space for retaining the upper portion of the engaging portion of the at least one contact, an intermediate space from which projects the at least one protrusion of at least one of the at least two opposite inner walls, and a lower opening space for receiving the lower portion of the engaging portion of the at least one contact, and wherein the upper opening space is dimensioned to be substantially equal to the size of the upper portion of the engaging portion of the at least one contact thereby restricting lateral movement of the contact.

3. The electrical connector as claimed in claim 2, wherein the lower opening of the housing is larger than the lower portion of the contact.

4. An electrical connector comprising:

an insulative housing and at least one contact detachably received in the housing;

the insulative housing comprising a bottom, two side walls projecting upward from the bottom, and a slot defined between the bottom and the two side walls for receiving a complementary connector;

at least one aperture being defined in the bottom of the insulative housing bound by at least two opposite inner walls and at least one protrusion projecting laterally from an intermediate portion of at least one of the at least two inner walls;

the at least one contact comprising a contacting portion for electrically contacting with a corresponding contact of the complementary connector received in the slot, an engaging portion including an upper portion, an intermediate portion which is formed with at least one curved concave portion detachably received in the at least one aperture of the housing, and a lower portion, and wherein the upper portion is wider than both the intermediate and the lower portions, and the intermediate portion is narrower than the lower portion, and a soldering portion extending from the engaging portion for being soldered to an external printed circuit board;

wherein the at least one curved concave portion of the at least one contact slidably engages with the at least one protrusion of in the at least one aperture of the insulative housing;

wherein the at least one aperture of the bottom of the insulative housing has an upper opening space for retaining the upper portion of the engaging portion of the at least one contact, an intermediate space from which projects the at least one protrusion of at least one of the at least two opposite inner walls, and a lower opening space for receiving the lower portion of the engaging portion of the at least one contact, and wherein the upper opening space is dimensioned to be substantially equal to the size of the upper portion of the engaging portion of the at least one contact thereby restricting lateral movement of the contact.

* * * * *